US005548082A

United States Patent [19]

Palmer

[11] Patent Number: 5,548,082

[45] Date of Patent: Aug. 20, 1996

[54] PASSIVE SIGNAL SHIELDING STRUCTURE FOR SHORT-WIRE CABLE

[76] Inventor: Donald E. Palmer, 1275 Vicente Dr. #189, Sunnyvale, Calif. 94086

[21] Appl. No.: 343,698

[22] Filed: Nov. 22, 1994

[51] Int. Cl.[6] ..... H01B 11/02

[52] U.S. Cl. ..... 174/34; 174/36; 333/4; 307/89

[58] Field of Search ..... 174/32, 34, 36; 333/4; 307/89, 91

[56] References Cited

U.S. PATENT DOCUMENTS

| | | | |
|---|---|---|---|
| 295,086 | 3/1884 | Waring . | |
| 2,943,272 | 6/1960 | Feldman | 333/1 X |
| 4,586,008 | 4/1986 | Raleigh | 333/19 X |
| 4,754,102 | 6/1988 | Dzurak | 174/36 |
| 5,033,091 | 7/1991 | Bond | 381/94 X |
| 5,061,821 | 10/1991 | Nercessian | 174/34 |
| 5,142,252 | 8/1992 | Brisson | 333/4 |
| 5,218,507 | 6/1993 | Ashley | 361/107 X |
| 5,393,933 | 2/1995 | Goertz | 174/117 X |

*Primary Examiner*—Kristine L. Kincaid
*Assistant Examiner*—Chau N. Nguyen
*Attorney, Agent, or Firm*—Townsend and Townsend and Crew LLP; Kenneth R. Allen

[57] ABSTRACT

A signal shielding structure for a cable, such as an audio cable, employs 1) a shielding sheath which is electrically insulated from and encloses the signal-carrying conductors in the cable and 2) one or two discrete inductors electrically coupled between selected discrete points of termination on the shielding sheath and selected ground points to provide a d.c. signal path to ground and to inhibit ground termination of r.f. signals. The shielding sheath floats and is preferably everywhere electrically isolated from direct-wire connection with all grounds and all signal sources except for the connection through the inductor or inductors.

10 Claims, 1 Drawing Sheet

PASSIVE SIGNAL SHIELDING STRUCTURE FOR SHORT-WIRE CABLE

BACKGROUND OF THE INVENTION

This invention relates to audio high fidelity cable wherein the wavelength of signals carried on the cable is generally longer than the length of the cable (i.e., a short-wire cable), such as in audio signal and high fidelity sound reproduction applications. The invention has particular application where the range of frequencies is greater than several octaves and therefore broadband random noise can have potentially significant impact on the fidelity of a complex signal carried by the cable.

It is common practice in audio frequency circuitry to provide a shielding sheath surrounding signal-carrying conductors between subsystems and within components of an audio system. It is conventional in shielded audio cables to provide a direct connection from a local ground to the shielding sheath of the cable in an attempt to terminate spurious signals to ground.

Conventional shielding provides protection against external noise sources by terminating the external signals that are coupled into the shield to prevent them from being inductively coupled from the shield into the signal-carrying conductors.

It is generally thought that if the shield is not grounded from direct current (d.c.) through radio frequency (r.f.), the efficiency of the shield will be reduced, and the r.f. noise induced from the shield into the cable will be increased. These are both undesirable effects. Therefore, the conventional solution in audio cable applications is to connect the shield directly to the signal ground or to the chassis ground.

However, there are evidently other sources of signal distortion in audio applications that are not completely understood and that conventional grounding does not address. What is desired is a technique for improving the perception of sound quality.

A search by the applicant for patents in the fields related to shielding techniques failed to uncover any patents which suggested the use of isolation techniques for shielding. To this end, a search was conducted among the U.S. Patent Office records relating to noise suppression and wiring, transmission lines and cables, including Class 174, Subclasses 32–36; Classes 307, Subclasses 89 and 91; and Class 333, Subclasses 4 and 6, for records as of summer 1994, and no relevant patents were uncovered.

SUMMARY OF THE INVENTION

According to the invention, a signal shielding structure for a cable, such as an audio cable, employs 1) a shielding sheath which is electrically insulated from and encloses the signal-carrying conductors in the cable and 2) one or two discrete inductors electrically coupled between selected discrete points of termination on the shielding sheath and selected ground points to provide a d.c. signal path to ground and to inhibit ground termination of r.f. signals. The shielding sheath typically floats and is preferably everywhere electrically isolated from direct-wire connection with all grounds and all signal sources except for the connection at or through the inductor or inductors. There will still be a beneficial effect under circumstances where there are paths to ground where the impedance is higher than the d.c. impedance of the inductor or inductors. It is preferable that all low impedance paths be minimized.

There is not a clear reason why a structure of this type produces perceived audio signal fidelity improvements rover the conventional shielding structure. In fact, logic would seem to argue for a low-impedance termination for all undesired signals impinging on the shield. In a conventional environment, a cable shielding scheme according to the invention produces perceptible audio fidelity improvement. The perceived improvements in audio quality seem to be consistent when used in a variety of locations in the audio signal path. Tests have included phonograph cartridge to preamplifier, CD player to preamplifier, preamplifier to amplifier, and amplifier to speaker. There may be environments where such an improvement is not perceivable, such as in the case of strong r.f. environments. However, because of the nature of the termination, the sound quality may be tailored or optimized by varying the value and the ground termination point of the inductor. Thus there are advantages to the use of this type of cabling.

DESCRIPTION OF SPECIFIC EMBODIMENTS

Figure 1:
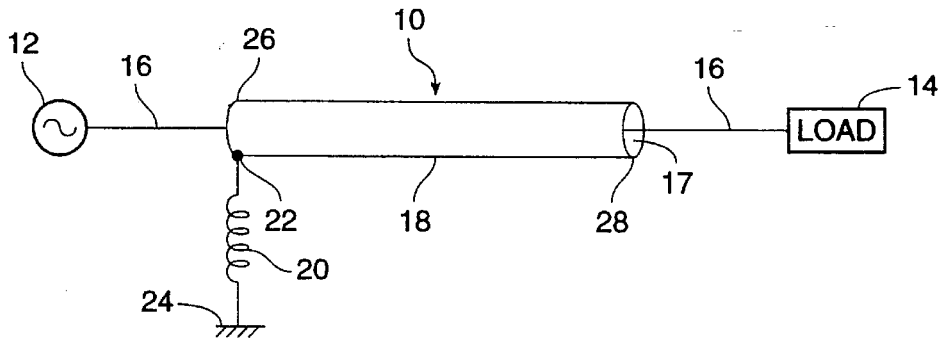
FIG. 1 is schematic block diagram of a first cable configuration according to the invention.

FIG. 1 is schematic block diagram of a first configuration of a cable 10 according to the invention attached between a source 12 and a load 14. A single signal line 16 electrically connects the source 12 with the load 14 and is shielded by an electrically-conductive shielding sheath 18, with electrical insulation 17 separating the signal line 16 from the sheath 18. According to the invention, an inductor 20, such as a coil having a value in the range of 0.1 μH to 100 μH, is electrically coupled between a junction point 22 on the sheath 18 and a local ground 24. The junction point 22 is selected in this particular embodiment to be at the source end 26 of the sheath 18. However, the junction point 22 may alternatively be at the load end 28 of the sheath 18. There are no other electrical connections of an impedance less than the d.c. impedance of the inductor, including direct ground connections, with the sheath 18.

A typical application of the cable 10 is internal wiring of an audio amplifier, as between amplifier stages or output stages and output terminals.

In operation, it appears that noise from undesired sources is perceptively reduced and evidently does not propagate between stages.

Figure 2:
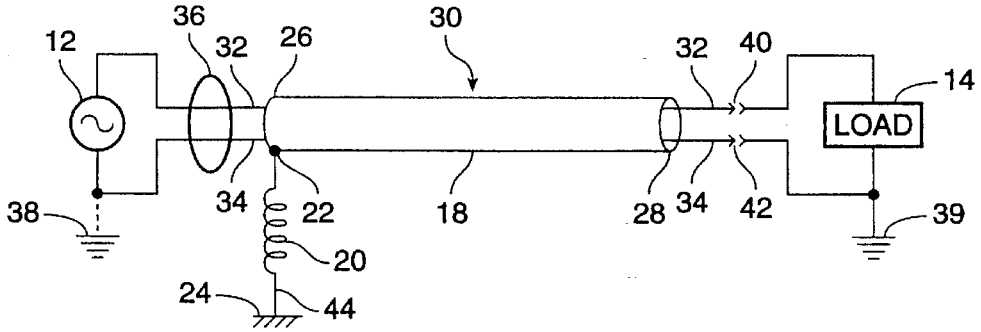
FIG. 2 is schematic block diagram of a second cable configuration according to the invention.

Other configurations are contemplated. Referring to FIG. 2, there is shown a schematic block diagram of a second configuration of a cable 30 according to the invention attached between a source 12 and a load 14. A balanced or unbalanced dual conductor signal line set 36 consisting of individually-insulated signal lines 32 and 34 electrically connects the source 12 with the load 14 and is shielded by an electrically-conductive shielding sheath 18. The wire lines 32 and 34 may be twisted along the signal path.

According to the invention, an inductor 20, such as a coil having a value in the range of 0.1 μH to 100 μH, is electrically coupled between junction point 22 on the sheath 18 and local ground 24. The junction point 22 is selected in this particular embodiment to be at the source end 26 of the sheath 18. However, the junction point 22 may alternatively be at the load end 28 of the sheath 18. There are no other electrical connections of an impedance less than the d.c. impedance of the inductor, including direct ground connections, with the sheath 18. However, one of the wire lines 32, 34 could be referenced to signal ground 38 to create an unbalanced feed line.

A typical application of the cable 30 is a balanced audio cable for a microphone or loudspeaker or an unbalanced audio cable between standalone audio subsystems, with mating connectors 40 and 42 at the ends. The connectors 40 and 42 may be unbalanced or balanced, the balanced connectors being floating with respect to ground and with a signal ground internal to the source 12 or load 14 subsystem. Either floating or grounded RCA connectors are typical examples. In an embodiment where the chassis ground 24 is at one end of the sheath 18 adjacent a connector set (not shown), the inductor 20 may be connected to the signal ground 38 through one of the connector contacts (not shown). In the embodiment shown, the inductor 20 is connected to a common ground 24 through a flying pigtail lead 44 from the inductor 20.

Figure 3:
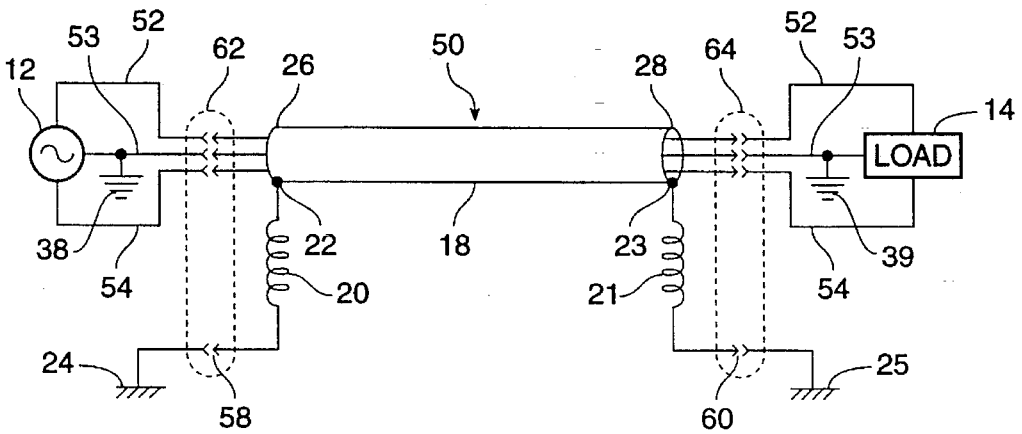
FIG. 3 is schematic block diagram of a third cable configuration according to the invention.

Referring to FIG. 3, there is shown a still further schematic block diagram of a third configuration of a cable 50 according to the invention attached between a balanced source 12 and a balanced load 14. A balanced triple-conductor signal line set 56 consisting of individually-insulated signal lines 52, 53 and 54 electrically connects the source 12 with the load 14 and is shielded by an electrically-conductive shielding sheath 18. The wire lines 52, 53 and 54 include two signal-carrying lines 52 and 54 with a ground line 53 and may be twisted together along the signal path within the sheath 18. The ground line 53 is connected at one end to signal ground 38 and at the other end to signal ground 39.

According to the invention, inductors 20 and 21, such as coils each having a value in the range of 0.1 μH to 100 μH, are electrically coupled between junction points 22 and 23 on the sheath 18 and local grounds 24 and 25. The junction points 22 and 23 are selected in this particular embodiment to be at both the source end 26 and the load end 28 of the sheath 18. In a disconnectable cable application, the inductors 20 and 21, as in the prior embodiments, are connected between the sheath and the local ground points 24 and 25 through pin and jack pairs 58 and 60 in cable end connector pairs 62 and 64, so that the shielding sheath 18 is r.f.-isolated from ground.

However, merely one junction point 22 may alternatively be at either the source end 26 or the load end 28 of the sheath 18. There are no other electrical connections of an impedance less than the d.c. impedance of the inductor, including direct ground connections, with the sheath 18.

A typical cabling application of the embodiment of FIG. 3 is a three-conductor audio cable with a shielding sheath, as used with a microphone, employing XLR male and female four-conductor connectors at each end.

The invention has now been explained with reference to specific embodiments. Other embodiments will be apparent to those of ordinary skill in this art. It is therefore not intended that this invention be limited, except as indicated by the appended claims.

What is claimed is:

1. In a short-wire cable having signal carrying conductors, a signal shielding structure for said signal-carrying conductors, said structure comprising:

a shielding sheath, said shielding sheath being an electrical conductor which is electrically insulated from and enclosing said signal-carrying conductors along said short-wire cable; and at least one discrete inductor, said discrete inductor being electrically coupled between a selected discrete termination point at one end of said shielding sheath and a termination point to provide a path for d.c. signals to ground and to inhibit ground termination of r.f. signals, wherein said shielding sheath is otherwise electrically isolated from power and signal sources and from ground connection.

2. The signal shield structure according to claim 1, wherein all electrical paths to all grounds and all of said signal sources from said shielding sheath are of an impedance higher than d.c. impedance of said at least one discrete inductor.

3. The signal shielding structure according to claim 1 wherein said shielding sheath encloses one signal-carrying conductor.

4. The signal shielding structure according to claim 1, wherein said signal-carrying conductors include two signal-carrying wires within said shield.

5. The signal shielding structure according to claim 1, 2, 3 or 4, wherein said selected discrete termination point is at a source end.

6. The signal shielding structure according to claim 1, 2, 3 or 4, wherein said selected discrete termination point is at a load end.

7. The signal shielding structure according to claim 1, 2, 3 or 4, wherein said selected discrete termination point includes a source end termination point and a load end termination point, wherein said at least one discrete inductor comprises a first inductor which is provided at said source end termination point and a second inductor which is provided at said load end termination point.

8. A short-wire cable comprising:

at least one signal-carrying conductor for carrying signals;

electrical connectors at each end of said signal-carrying conductor for allowing electrical connection and disconnection of said signal-carrying conductor with external electrical equipment; and a signal shielding structure for said signal-carrying conductor, said structure comprising:

a shielding sheath, said shielding sheath being an electrical conductor which is electrically insulated from and enclosing said signal-carrying conductor along said short-wire cable; and at least one discrete inductor, said discrete inductor being electrically coupled between a selected discrete termination point at one end of said shielding sheath and an electrical contact for connection to ground to provide a path for d.c. signals to said electrical contact and to inhibit low impedance termination of r.f. signals, and wherein said shielding sheath is otherwise electrically isolated from power and signal sources and from ground connection.

9. The cable according to claim 8, wherein said at least one discrete inductor comprises a first inductor and a second inductor, wherein said selected discrete termination point includes a source end termination point and a load end termination point, wherein said first inductor is connected to said source end termination point and said second inductor is connected to said load end termination point.

10. A method of shielding at least one signal-carrying conductor in a short-wire cable, said method comprising:

providing a shielding sheath, said shielding sheath being an electrical conductor which is electrically insulated from and enclosing said at least one signal-carrying conductor along said short-wire cable;

coupling at least one discrete inductor between a first selected discrete termination point at one end of said shielding sheath and a second discrete termination point to provide a path for d.c. signals to ground and to inhibit ground termination of r.f. signals; and electrically isolating said shielding sheath from power and signal sources and from ground connection except through said discrete inductor.

* * * * *